United States Patent [19]

Spellman, Jr.

[11] Patent Number: 4,640,662

[45] Date of Patent: Feb. 3, 1987

[54] FORK LIFT ATTACHMENT FOR TRACTOR

[75] Inventor: Francis T. Spellman, Jr., Blue Springs, Mo.

[73] Assignee: Hy-Lite Mfg. Co., Inc., O'Fallon, Mo.

[21] Appl. No.: 740,735

[22] Filed: Jun. 3, 1985

[51] Int. Cl.[4] ..... B66F 9/20

[52] U.S. Cl. ..... 414/642; 414/920

[58] Field of Search ..... 414/629, 631, 632, 634, 414/635, 920, 637–642, 662–664, 667, 671, 703, 717

[56] References Cited

U.S. PATENT DOCUMENTS

| | | | |
|---|---|---|---|
| 2,904,203 | 9/1959 | Mindrum | 414/667 |
| 2,923,426 | 2/1960 | Brandt | 414/635 |
| 4,369,861 | 1/1983 | Rietman | 414/642 X |
| 4,379,673 | 4/1983 | Takahashi et al. | 414/703 X |
| 4,392,773 | 7/1983 | Johannson | 414/667 |

FOREIGN PATENT DOCUMENTS

| | | | |
|---|---|---|---|
| 648761 | 1/1951 | United Kingdom | 414/70.3 |

*Primary Examiner*—Joseph E. Valenza
*Assistant Examiner*—David A. Bucci
*Attorney, Agent, or Firm*—Andrus, Sceales, Starke & Sawall

[57] ABSTRACT

A fork lift attachment for a tractor. The fork lift attachment includes a subframe having a pair of arms that are attached to the sides of the tractor. A mast is pivoted to the outer end of the subframe and is adapted to be pivoted in a fore and aft direction by a hydraulic cylinder unit. Mounted for movement on the mast is a fork rack and a sliding rack, which carries the lift forks, is mounted for lateral movement on the fork rack. A pair of lift cylinders are mounted along the sides of the mast and operate to move the fork rack and lift forks relative to the mast, while a shift cylinder interconnects the fork rack and the sliding rack to shift the sliding rack and forks in a lateral direction. The lift cylinders are spaced apart to provide an opening for the power take-off of the tractor so that the fork lift attachment does not interfere with normal operation of the power take-off or the three-point hitch system.

5 Claims, 5 Drawing Figures

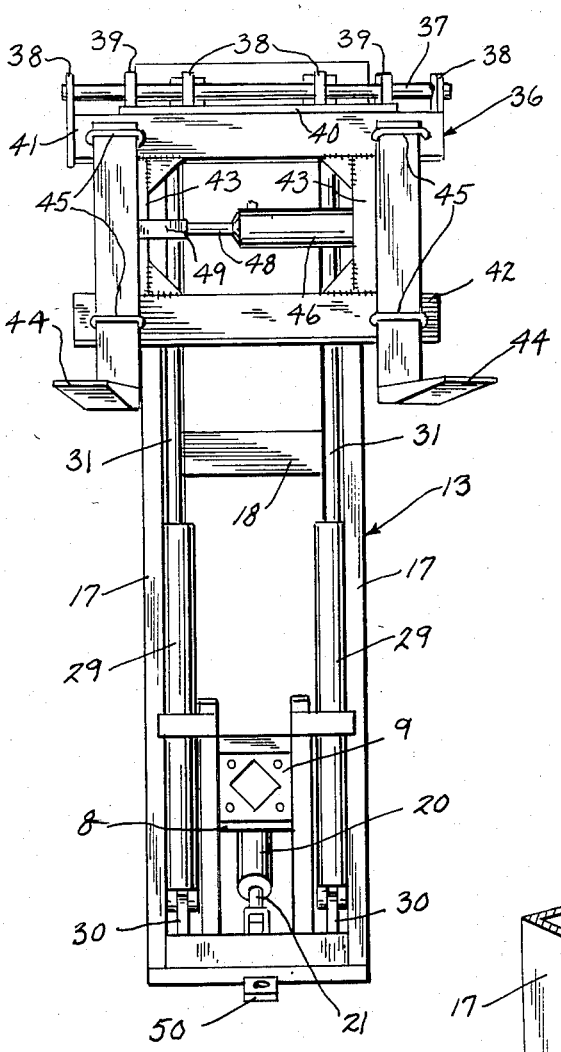
FIG. 4
FIG. 5
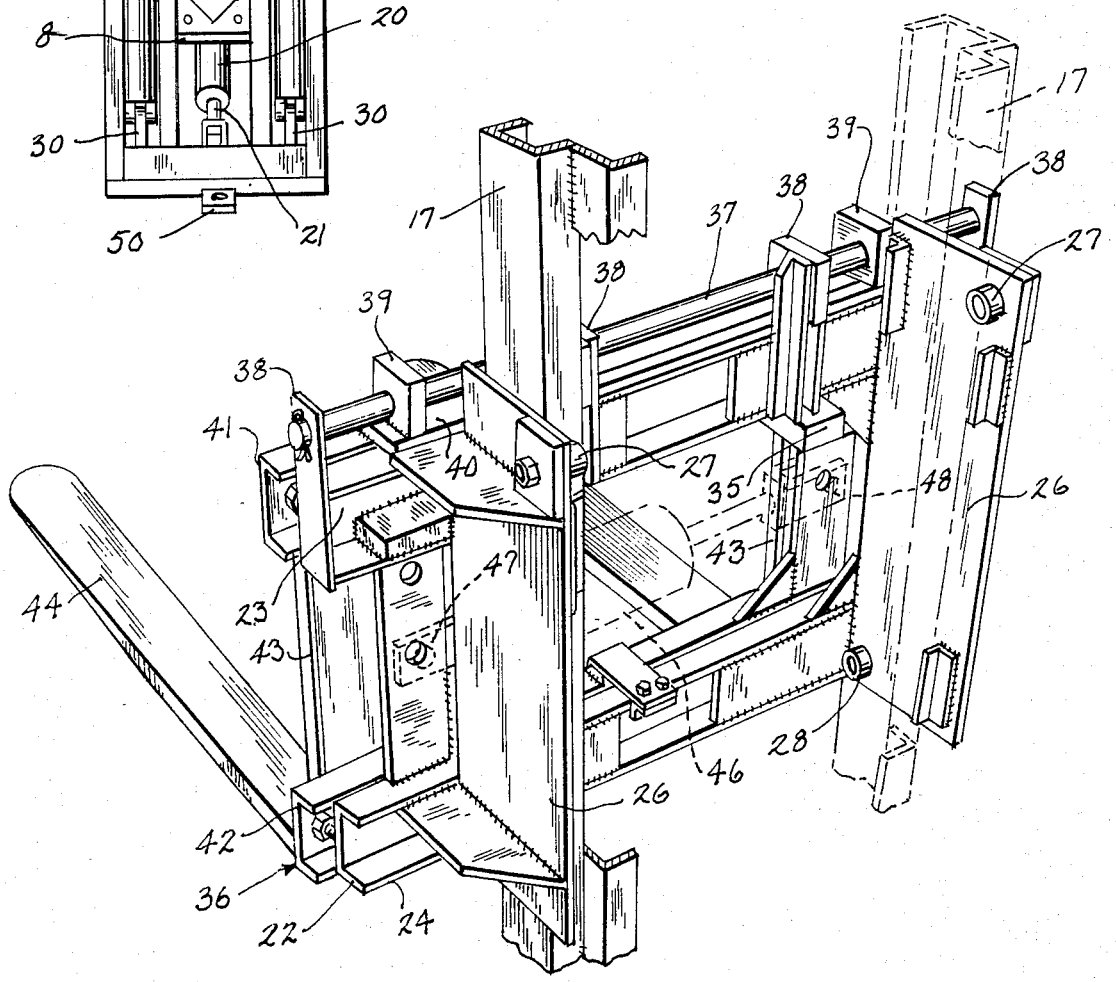

FORK LIFT ATTACHMENT FOR TRACTOR

BACKGROUND OF THE INVENTION

The conventional three-point hitch system is used with a tractor to operate implements such as a tiller, scoop, gang mower, rotary mower, post hole digger, pulverizer, plow blade, or the like. Frequently, there is also need for a fork lift for loading operations, and fork lifts have been designed for mounting on the three-point hitch system of the tractor, as shown in U.S. Pat. Nos. 2,868,399 and 4,394,107.

However, a fork lift attachment as mounted on the three-point hitch system has certain limitations. Initially, this type of fork lift attachment is only capable of lifting a maximum of 3,000 lbs. and generally only about 1,500 lbs. Further, it is necessary to remove the fork lift attachment from the three-point hitch system in order to use other implements with the tractor.

SUMMARY OF THE INVENTION

The invention is directed to an improved fork lift attachment for a tractor in which the fork lift attachment is independent of the three-point hitch system, thus leaving the three-point hitch system free for mounting of other implements.

In accordance with the invention, the fork lift attachment includes a sub-frame having a pair of generally parallel spaced arms which are attached to the sides of the tractor. A mast is pivoted for fore and aft movement on the outer end of the sub-frame and a cylinder unit interconnects the sub-frame and the mast to provide the pivotal fore and aft movement through an arc of about 10°.

Mounted for movement on the mast is a fork rack, and a sliding rack, which carries the lift forks, is mounted for lateral movement on the fork rack.

The fork rack and lift forks are raised and lowered by a pair of lift cylinders which are mounted along the sides of the mast, and the central portion of the mast is open to receive the power take-off and central link of the three-point hitch.

The sliding rack which carries the lift forks can be moved laterally relative to the fork rack by a shift cylinder which interconnects the two racks.

Other objects and advantages will appear in the course of the following description.

DESCRIPTION OF THE DRAWINGS

The drawings illustrate the best mode presently contemplated of carrying out the invention.

In the drawings:

FIG. 4 is a rear view of the attachment; and

FIG. 5 is a perspective view of the lower portion of the attachment with parts broken away in section.

DESCRIPTION OF THE ILLUSTRATED EMBODIMENT

Figure 1:
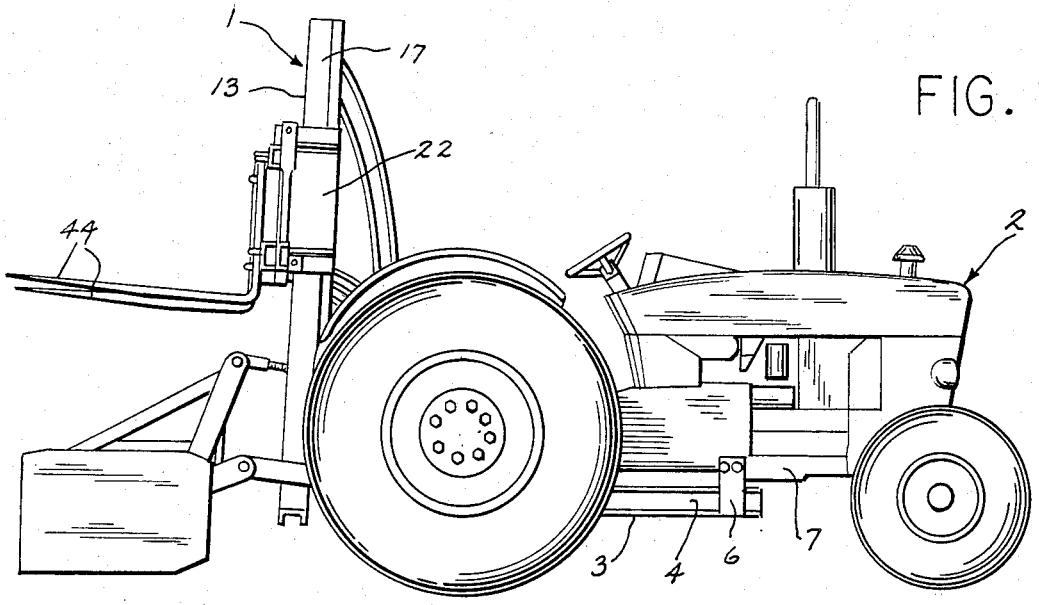
FIG. 1 is a side elevation of the fork lift attachment as mounted on a tractor.

The drawings illustrate a fork lift attachment 1 for a tractor 2. The fork lift attachment can be permanently connected to the tractor and will not interfere with the use of other three-point hitch implements such as pulverizers, plow blades, rotary mowers, scoops, post hole diggers, and the like.

The fork lift attachment 1 includes a sub-frame 3 composed of a pair of generally parallel side members 4 which which are connected together by cross members 5. The free ends of side members 4 are provided with upwardly extending brackets 6 which are bolted to the engine block 7 of the tractor.

Figure 2:
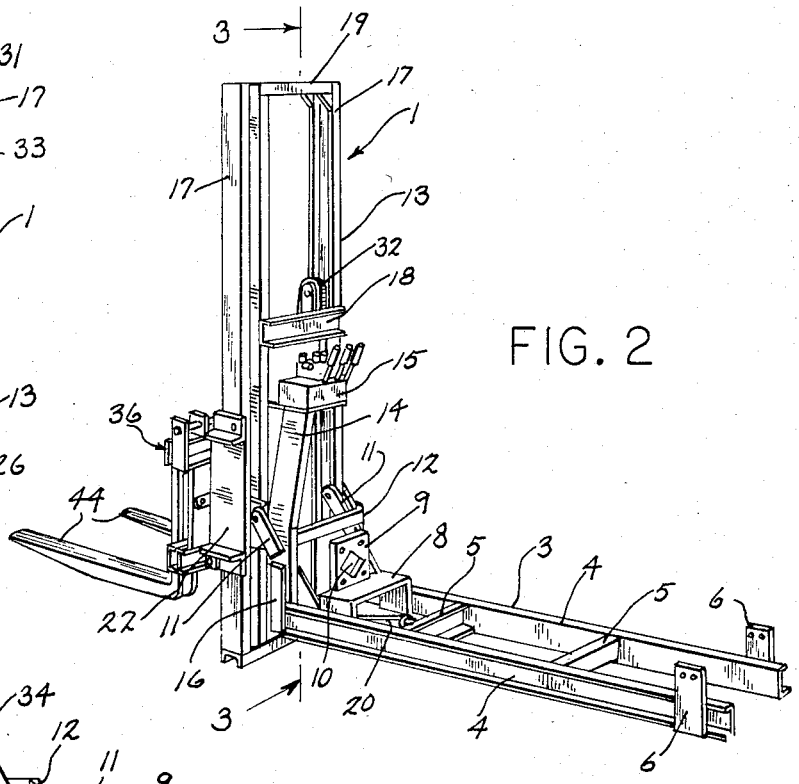
FIG. 2 is a perspective view of the sub-frame and fork lift attachment.
Figure 3:
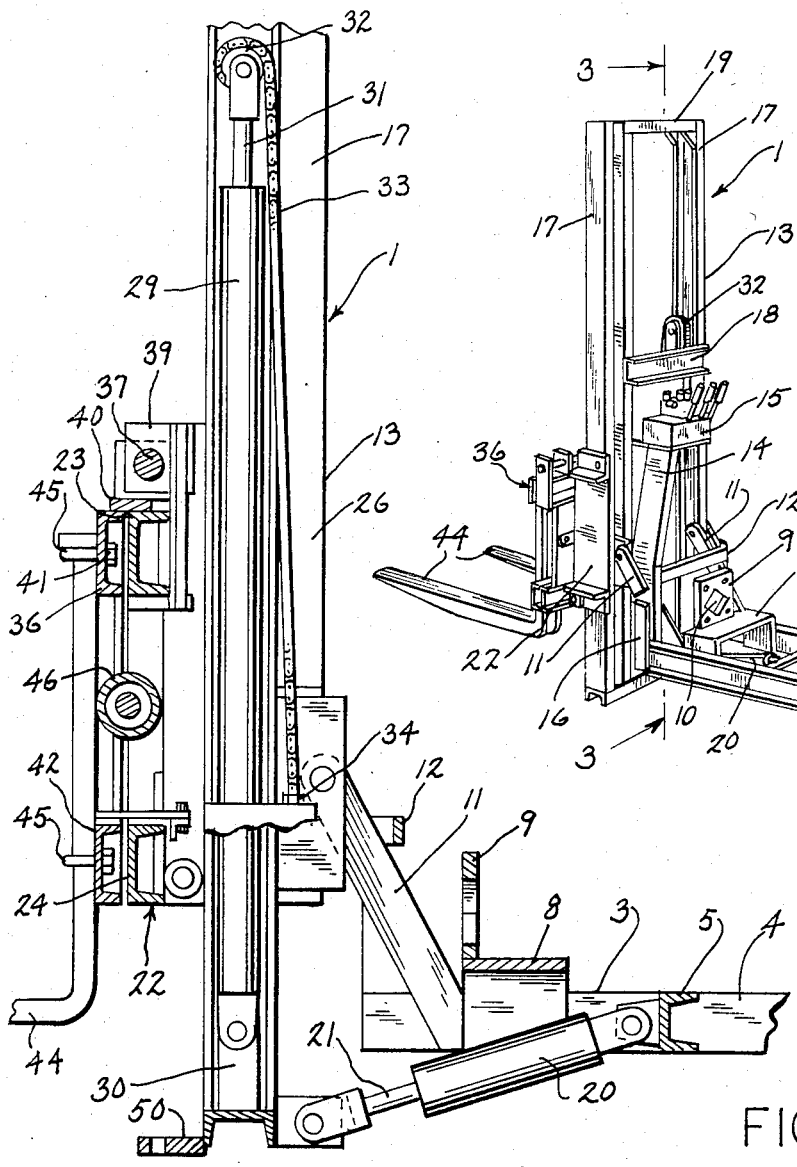
FIG. 3 is an enlarged side elevation of the fork lift attachment.

As best illustrated in FIGS. 2 and 3, the opposite end of the subframe includes a cross channel 8 and a vertical plate 9 is mounted edgewise on the upper surface of cross plate 8 and is provided with an opening 10 through which the power take-off of the tractor extends.

Extending rearwardly and upwardly from the subframe 3 are two pair of legs 11 which are connected by a cross arm 12, and a vertical mast 13 is pivotally connected to legs 11.

In addition, a post or pedestal 14 is attached to the outer end of subframe 3, as shown in FIG. 2, and the upper end of the post carries the valve block 15 which controls the hydraulic system for the fork lift attachment. As shown in FIG. 2, side brackets 16 are secured to the sides of the outer end of subframe 3 and serve to space the outer arms of the three point hitch away from the subframe.

Mast 13 is composed of a pair of spaced channel-shaped side members 17 which are connected along their length by a central cross channel 18 and a top member 19. Mast 13 is adapted to be tilted with respect to the subframe to an angle of about 10° in a fore and aft direction. The fore and aft tilt is employed to maintain the load on the lift forks in a generally horizontal attitude in the event the tractor is at an incline or moves over uneven terrain.

To tilt the mast 13, a hydraulic cylinder 20 is mounted beneath subframe 3 and one end of cylinder 20 is connected to one of the cross members 5 of the subframe, as illustrated in FIG. 3. The piston rod extends outwardly from the cylinder and is connected to the lower end of mast 13 at a level beneath the pivotal connection of the mast to the legs 11. By extending and withdrawing the piston rod, mast 13 can be pivoted in a fore and aft direction with respect to subframe 3.

A fork rack 22 is mounted for vertical movement on mast 13. As best illustrated in FIG. 3, fork rack 22 includes an upper channel 23 and a lower channel 24 which are connected by vertical column. A pair of plates 26 extend from channels 23 and 24 in a direction toward tractor 2, and a pair of upper rollers 27 are journaled on the upper corners of plates 26, while a pair of lower rollers 28 are journaled on the lower corners of plates 26 adjacent channel 24. Rollers 27 and 28 are adapted to ride against the forward and rear edges of the mast side members 17 as the fork rack 22 is raised and lowered.

To raise and lower fork rack 22, a pair of lift cylinders 29 are utilized. As shown in FIG. 4, lift cylinders 29 are located along the sides of the mast 13 with a substantial space therebetween through which the power take-off and the central arm of the three point hitch extend. With this construction the mast 13 and lift cylinders 29 will not interfere with the normal operation of the power takeoff or three-point hitch.

The lower ends of cylinders 29 are pivotally connected through lugs 30 to the lower end of mast 13. Piston rods 31 extend from the upper ends of lift cylinders 29 and sprockets 32 are mounted for rotatation on the upper end of each rod. A roller link chain 33 is engaged with each of the sprockets 32 and one end of each chain 33 is dead-ended on a bracket 34 on mast 13, while the opposite end of each chain is connected to a lift block 35 on the fork rack 22. Extension and contraction of piston rods 31 will thereby raise and lower the fork rack 22 relative to the mast. The use of the chains 33 provides a greater length of travel for the fork rack 22 for each increment of movement of the piston rod.

Mounted for lateral sliding movement on fork rack 22 is a sliding rack 36. To mount the rack 36 for sliding movement relative to rack 22, a rod 37 is mounted in spaced relation above upper channel 23 of fork rack 22 through lugs 38. The upper end of the sliding rack 36 is also provided with a pair of lugs 39 which are slidable on rod 37. To also aid in supporting the sliding rack 36 from fork rack 22, a lip plate 40 is attached to the upper surface of sliding rack 36 and extends rearwardly, i.e. in a direction toward tractor 2, over the upper surface of upper channel 23 of fork rack 22. Lip 40 aids in supporting the sliding rack.

As best illustrated in FIG. 5, sliding rack 36 comprises an upper channel 41, a lower channel 42 and a pair of vertical connecting plates 43 which connect the side edges of upper and lower channels 41 and 42. A pair of forks 44 are secured to the channels 41 and 42 by U-clamps 45, respectively.

To shift the sliding rack 36 laterally with respect to fork rack 22, a cylinder 46 is pivotally connected though clevis 47 to one of the vertical columns 25 of fork rack 22, while piston rod 48, which is slidable within cylinder 46, is connected through clevis 49 to one of the vertical bars 43 of the sliding rack 36. By extending and withdrawing piston rod 48, the sliding rack 36 can move through a limited stroke of movement laterally with respect to the fork rack 22. This lateral movement enables the forks 44, when carrying a load, to be shifted laterally relative to the fork lift attachment 1 and tractor 2 to move the load away from other loads, or to move a load tight up against an existing load.

It is also contemplated that a mast mounted drawbar 50 can be utilized for towing certain types of implements.

The fork lift attachment of the invention is mounted independently of the normal three-point tractor hitch system, thus leaving the three point hitch system free for mounting all three point hitch implements.

The dual hydraulic cylinders 29 are mounted along the sides of the mast 13, which leaves the center space between the cylinders open to receive the center link of the three point hitch and the power takeoff. In addition, the spacing between the lift cylinders 29 provides better visibility for the operator during loading and transporting and during use of the power takeoff implements.

The fork lift attachment of the invention is operated through the hydraulic system of the tractor, or alternately, by an auxiliary system.

As the fork lift attachment of the invention is mounted independently of the three point tractor hitch system, the fork lift attachment does not have to be removed when using the three-point system.

As a further advantage, the fork lift has a substantially increased lifting capacity over fork lift attachments connected to the three point hitch system of the tractor, thereby enabling greater loads to be lifted to a greater height.

Various modes of carrying out the invention are contemplated as being within the scope of the following claims particularly pointing out and distinctly claiming the subject matter which is regarded as the invention.

I claim:

1. In combination, a tractor having a power take-off, three-point hitch means connected to the rear of the tractor and mounted for vertical pivotal movement relative to said tractor, said three-point hitch means including a pair of lower arms and an upper arm disposed between said lower arms and located at a higher level than said lower arms, a sub-frame including a pair of elongated members, means for rigidly connecting the forward ends of the elongated members to the respective sides of said tractor, an upstanding mast pivotally connected to the rear end of the sub-frame and including a pair of spaced side members, said power take-off being aligned with the space between said side members, rack means mounted for movement on said mast, a pair of lift forks carried by said rack means, and means for raising and lower said rack means relative to the mast to thereby raise and lower said forks, said upper arm extending through the space between said side members and said lower arms located outwardly of the respective side members, whereby said lift forks and said three-point hitch means can each be used independently without disconnecting the other from said tractor.

2. The attachment of claim 1, wherein said means for raising and lowering said rack means comprises a pair of hydraulic cylinders, each cylinder being mounted adjacent one of said side members of said mast.

3. The combination of claim 2, and including manually operated control means connected to said hydraulic cylinders and located between said side members of the mast at a level above said central arm.

4. The combination of claim 1, and including means for pivoting the mast relative to the sub-frame in a fore and aft direction.

5. The combination of claim 1, wherein said sub-frame includes a vertical plate disposed to be connected to said tractor and having an opening to receive said power take-off.

* * * * *